US005779033A

United States Patent [19]

Roegner

[11] Patent Number: 5,779,033

[45] Date of Patent: Jul. 14, 1998

[54] JEWELRY CARRYING CASE

[76] Inventor: DeAnna Roegner, 774 Mays Blvd., #10-405, Incline Village, Nev. 89451

[21] Appl. No.: 821,420

[22] Filed: Mar. 21, 1997

[51] Int. Cl.[6] ..... A45C 11/04

[52] U.S. Cl. ..... 206/6.1; 383/39; 383/40

[58] Field of Search ..... 206/6.1; 383/37, 383/39, 40; 190/102

[56] References Cited

U.S. PATENT DOCUMENTS

| | | | |
|---|---|---|---|
| D. 276,954 | 1/1985 | Kruger | D3/43 |
| D. 345,651 | 4/1994 | Copp | D3/285 |
| D. 355,301 | 2/1995 | Tumulty | D3/239 |
| D. 358,483 | 5/1995 | Cross et al. | D3/276 |
| 1,684,232 | 9/1928 | Levit . | |
| 1,705,149 | 3/1929 | Brady . | |
| 2,011,879 | 8/1935 | Stein | 150/1.6 |
| 2,359,372 | 10/1944 | Leader | 150/1 |
| 2,554,215 | 5/1951 | Schell et al. | 150/1.6 |
| 3,533,459 | 10/1970 | Ody | 150/28 |
| 3,900,060 | 8/1975 | Shammas | 206/6.1 |
| 4,365,433 | 12/1982 | Buell | 383/39 |
| 4,401,219 | 8/1983 | Mink | 206/6.1 |
| 4,513,866 | 4/1985 | Thomas | 206/570 |
| 4,585,127 | 4/1986 | Benedict | 211/34 |
| 4,735,246 | 4/1988 | Niehaus | 206/6.1 |
| 4,739,809 | 4/1988 | Adams | 150/112 |
| 4,854,432 | 8/1989 | Carpenter et al. | 190/110 |
| 4,930,635 | 6/1990 | Hotchkiss et al. | 206/6.1 |
| 4,947,987 | 8/1990 | Keenan | 383/40 |
| 4,960,204 | 10/1990 | Young et al. | 206/235 |
| 5,052,555 | 10/1991 | Harmon | 206/315.11 |
| 5,096,030 | 3/1992 | Espinosa et al. | 190/108 |
| 5,121,833 | 6/1992 | Lindsay et al. | 206/6.1 |
| 5,160,001 | 11/1992 | Marceau | 190/102 |
| 5,209,344 | 5/1993 | Smith | 206/6.1 |
| 5,246,103 | 9/1993 | Hicks | 206/6.1 |
| 5,295,587 | 3/1994 | Downes et al. | 206/6.1 |
| 5,423,404 | 6/1995 | Shaw | 190/102 |
| 5,598,923 | 2/1997 | Owens | 206/370 |

*Primary Examiner*—David T. Fidei
*Attorney, Agent, or Firm*—Baker, Maxham, Jester & Meador

[57] ABSTRACT

A carrying case for jewelry and the like, comprises a primary panel of pliable material having a generally rectangular configuration and an inner face and an outer face, the panel having a top end and a bottom end, hanging means at the top end, the panel foldable along a transverse line for forming a primary receptacle having a front panel and a back panel, a pocket assembly for detachably securing to the back panel inner face, the pocket assembly comprising a back pocket panel and a front pocket panel secured together along a bottom and side edges forming a pocket, and a mounting panel removeably mounted in the pocket and having a mounting face, a plurality of attachment loops on the mounting face for mounting articles of jewelry, an elongate generally cylindrical support member detachably mounted on the panel, and a cover panel secured along an edge to one of an upper and a lower edge of the mounting panel to thereby overlap and cover the mounting face.

20 Claims, 3 Drawing Sheets

FIG. 4
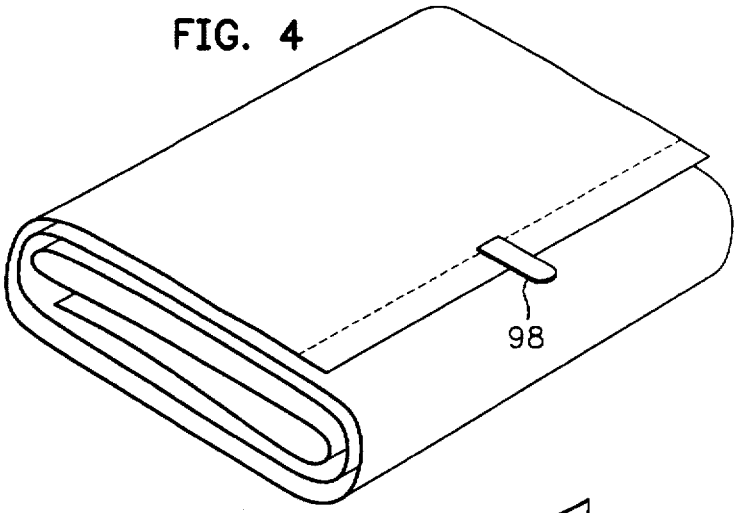
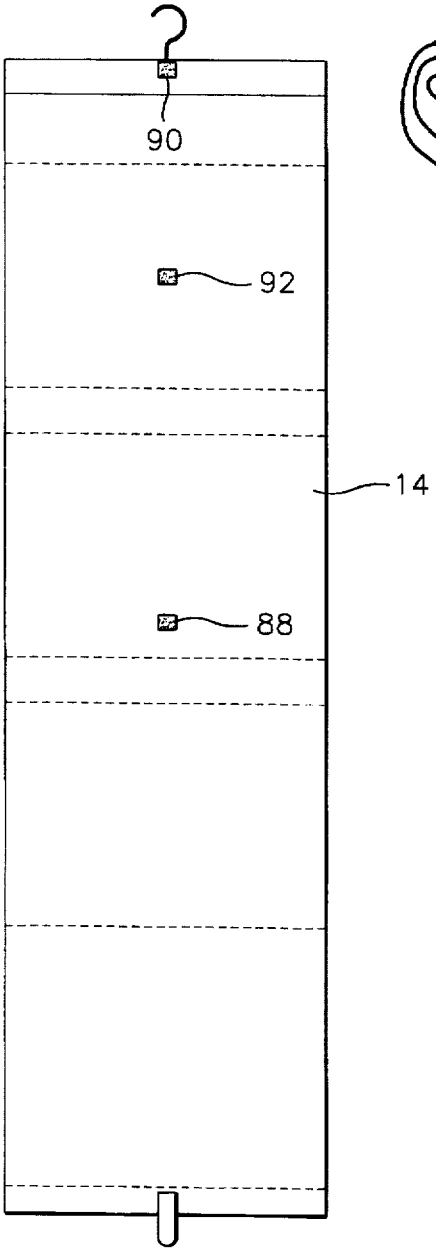
FIG. 3
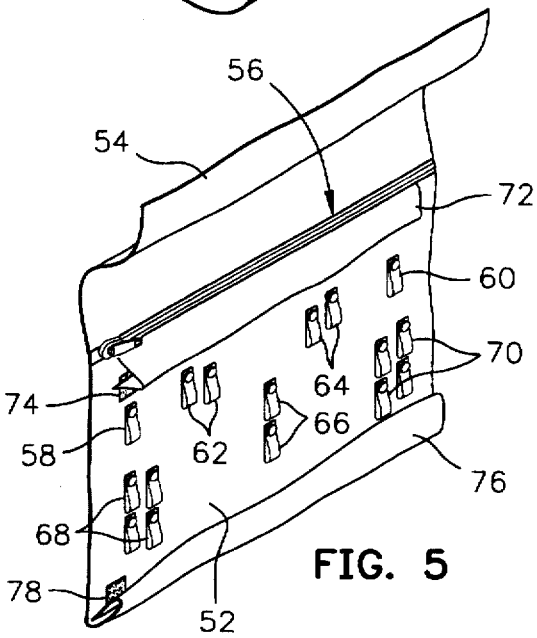
FIG. 5
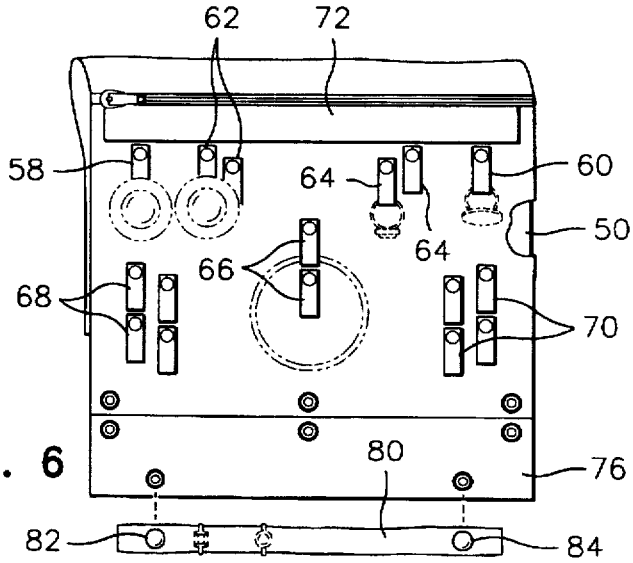
FIG. 6

JEWELRY CARRYING CASE

REFERENCE TO RELATED APPLICATION

The present application is related to co-pending design application Ser. No. 29/041,011, entitled "MULTIPOCKETED CASE", filed Jun. 26, 1995.

BACKGROUND OF THE INVENTION

The present invention relates to carrying cases and pertains particularly to an improved jewelry carrying case having an improved arrangement of multiple pockets and mounting panels for carrying multiple articles of jewelry in an organized fashion.

Many ladies have many items of jewelry which they take along when traveling. These items of jewelry are often placed loosely in a purse or suitcase. This often leaves the items disorganized, sometimes tangled and often difficult to easily locate.

There is a need for a jewelry carrying case that is adaptable to carry many different related or unrelated items of jewelry in an organized fashion. It would be desirable to have a case with multiple pockets with holders for holding many different sets of related articles for ease of location and retrieval.

SUMMARY OF THE INVENTION

It is the primary object of the present invention to provide an improved jewelry case with multiple pockets and attachment means for holding articles of different sizes secure and readily accessible in an organized arrangement.

A jewelry carrying case, comprises a primary rectangular panel of pliable material, said panel foldable along a transverse line forming a primary receptacle, a multi-pocket panel assembly detachably secured to said back panel and each pocket having a mounting panel with multiple attaching means for selectively mounting sets of related jewelry in selected locations on the panel, and said primary panel foldable to thereby overlap and enclose said plurality of pockets.

BRIEF DESCRIPTION OF THE PREFERRED EMBODIMENTS

The above and other objects and advantages of the present invention will become apparent from the following description when read in conjunction with the accompanying drawings wherein:

FIG. 1 is a perspective view of exemplary preferred embodiment of the invention with the case fully open;

FIG. 2 a perspective view like FIG. 1 with a pocket open and a holder shown removed and portions broken away to show details;

FIG. 2*a* is a back elevation view of a pocket of FIG. 2;

FIG. 3 is a back elevation view of the embodiment FIG. 1;

FIG. 4 is a perspective view of the invention showing the case in the closed position;

FIG. 5 is a perspective view of a holder of the invention showing the inside construction with the help of the holder open;

FIG. 6 is a front elevation view of the holder of FIG. 5, showing the mounting of selected articles of jewelry;

DETAILED DESCRIPTION OF THE PREFERRED EMBODIMENTS

Figure 1:
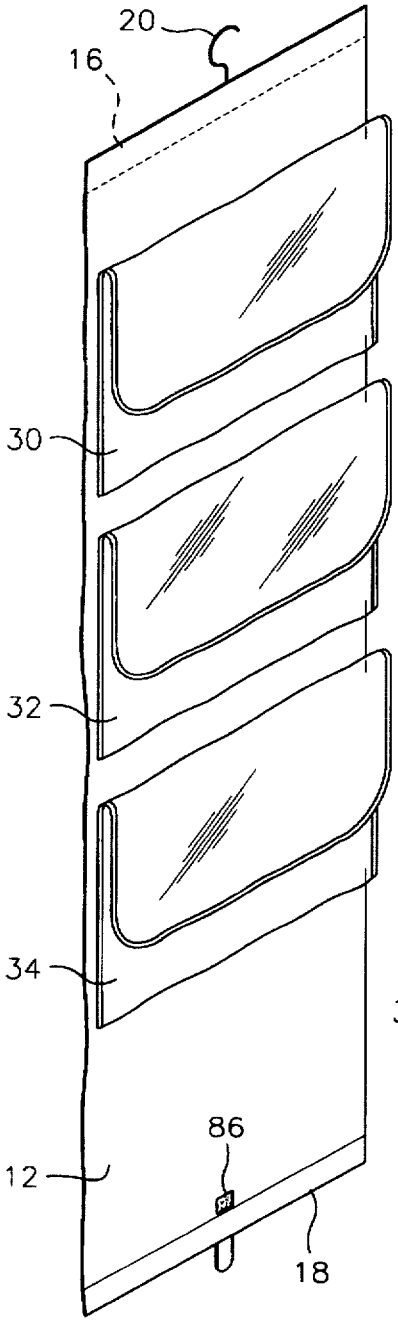
Figure 2:
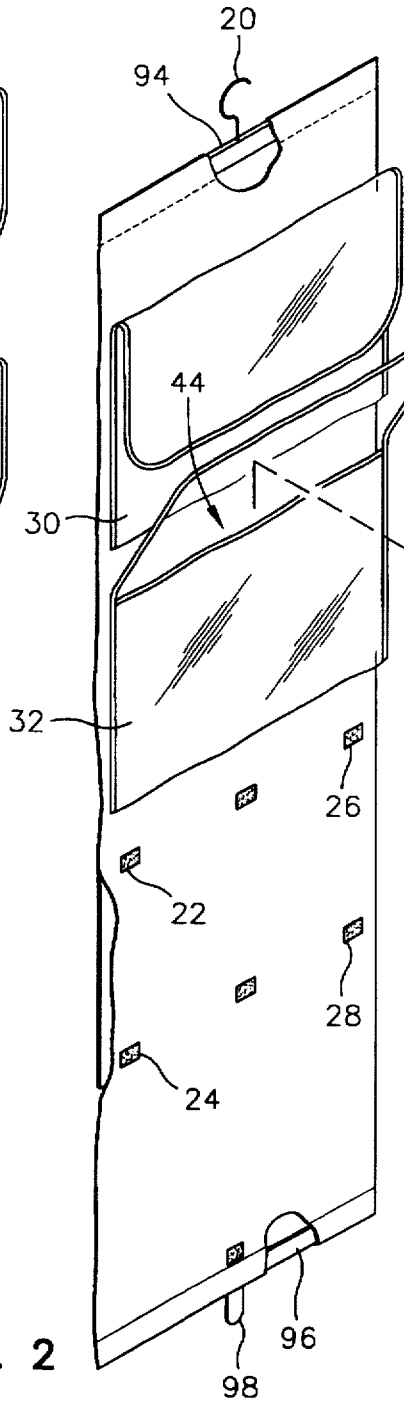
Figure 2A:
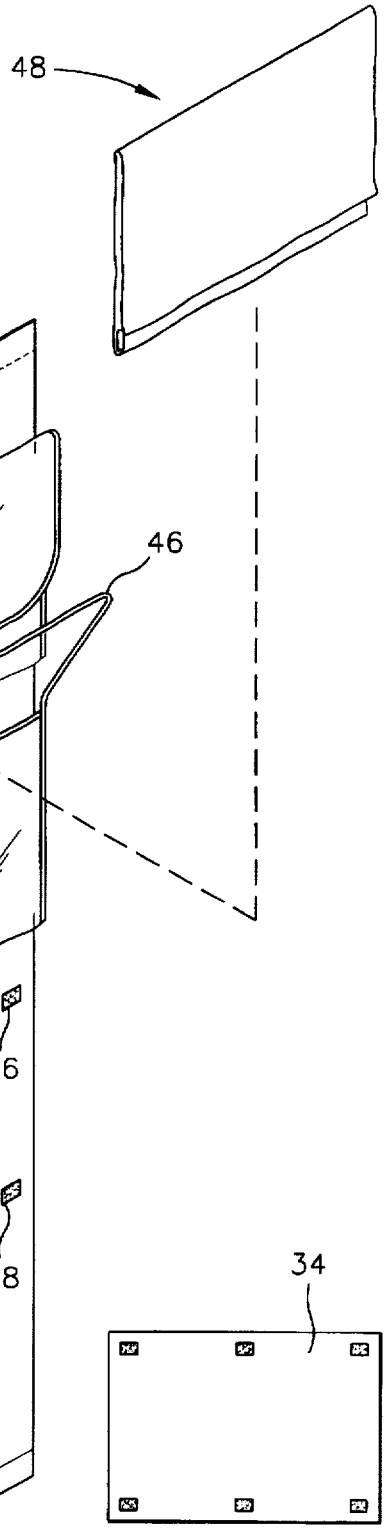

Referring to FIGS. 1–3 of the drawing, the carrying case in accordance with the invention is illustrated and designated generally by the numeral 10. The case is preferably constructed of a pliable material, such as leather, vinyl, or any of the suitable woven materials, now widely used for suit cases and the like. The case comprises a primary support and closure panel shell formed of a unitary elongated substantially rectangular panel having an inner face 12 and an outer face 14, and foldable along a transverse lines forming a primary receptacle, as illustrated in FIG. 4.

The primary support panel as shown in the illustrated embodiment comprises an elongated generally rectangular cover panel having an upper end 16 and a lower end 18 with a hanger hook or structure 20 at the upper end for hanging it on a suitable wall hook or closet clothes rod or any other suitable hanging means. The panel is provided on its inner surface, as illustrated in FIG. 2, with multiple sets of attachment means (only one set shown) 22, 24, 25, 26, 27 and 28 for detachably attaching a plurality of pocket assemblies. The illustrated embodiment is constructed for the attachment of three pocket assemblies or units 30, 32 and 34. Each pocket assembly is provided with attachment means in the form of hook and loop fastening means, commonly available under the trademark "velcro" for detachably attaching the pocket assemblies to the inside or inner face of the panel at the respective attachment set. For example, as illustrated in FIG. 2, pocket assembly 34 is shown removed and fastener pads 36, 37, 38, 39, 40 and 41 on the inner face 12 of the primary panel. The primary panel is also preferably provided with a stiffener panel, such as cardboard (only one shown) 29 at each pocket assembly attachment positions. The primary support panel has sufficient length to define a flap at the upper end and a flap at the lower end so that when rolled or folded over the pocket assemblies, the lower flap can be secured so that the case is in the closed condition with the support panel wrapped around the multiple pocket assemblies as shown in FIG. 4.

Referring now to FIG. 2, a pocket assembly 32 is illustrated as open and includes a mounting panel removed that will be described in detail. The illustrated pocket assembly has an outer envelope or pocket with hook and loop fastening pads or patches 36, 37, 38, 39, 40 and 41 positioned on the back of the engage pads 22, 23, 24, 26, 27 and 28 on support panel 12. Any suitable fasteners may be used, but hook and loop-type is preferred because it is quick and easy to locate or position and fasten.

The pocket assembly 32 is formed of an envelope-type structure with front and back panels secured along side and bottom edges to form a pocket having a top opening 44 and a flap 46 at the upper edge of the back panel folded over the opening 44 to close the pocket unit. The pocket may be made out of any suitable fabric material, as described above, and is preferably transparent at least as to the front panel and flap. Disposed within the pocket is a removable jewelry mounting panel designated generally at 48 adapted to mount and support a plurality of items of jewelry in a selected arrangement along a face of the panel.

Referring to FIGS. 5 and 6, the panel is preferably constructed with a reinforcing or stiffening panel 50, such as a cardboard rectangle, covered by a suitable fabric material, such as velvet or the like, forming a front face 52 and a back face (not shown) with a flap or cover panel 54 secured preferably along the top of the back panel and foldable down over the front face 52. The cover panel 54 is preferably of a size to cover the entire front face as shown in FIG. 2. The mounting panel assembly is preferably formed with a pocket having an opening 56 with a zipper closure transverse across the top so that the unit provides an enlarged pocket for containing selected items of jewelry. The opening may have a suitable closure, such as a zipper or the like, as shown.

The front or support face of the panel is provided with a plurality of small straps, each secured at one end to the face panel of fabric and detachably secured at the other end by suitable means, such as a snap or velcro fastener. The illustrated straps show the use of snaps to close and secure a loop formed by the respective strap. These straps may be individually positioned as at 58 and 60 for separate individual items. The straps may also be positioned in pairs as at 62, 64 and 66 or in groupings of multiple straps or pairs such as at 68 and 70 for suitable groupings of jewelry or the like.

The illustrated support panel is also provided with a fold 72 at the top which comprises a flap or panel of fabric folded, and detachably secured to face 52 as shown. The fold may fold over a necklace or the like, or have a necklace mounted on and folded over and secured by suitable means, such as hook and loop fasteners 74 as shown, or snaps. A similar fold 76 having fasteners such as at 78 may also be provided at the bottom of the face panel as illustrated. These folds may act as shallow pockets to contain necklaces within the folds as shown.

A ring mounting cylinder 80 is also detachably mounted on the lower front face of the mounting panel by suitable fastening means, such as hook and loop fastening means or a snap-type fasteners 82 and 84 as shown. This mounting cylinder is primarily suitable and provided for mounting of rings and may also be used for mounting other items. The mounting cylinder is at least detachably connected at one end to the mounting panel, but may be detachable from either end as shown. It may also be mounted to a fold as shown, or directly to the face 52. Tabs (not shown) may also be provided on the support panel for mounting of stud-type earrings.

In operation items of jewelry as shown in phantom (FIG. 6) are selected and selectively mounted in or on the mounting panel in a suitable manner. Selected items that are to be worn together may be grouped and positioned at selective positions around the face of the support panel. Rings may be mounted either in groups, or on selected straps 64 and 60 as illustrated, or on the mounting cylinder 80 as shown. Similarly, bracelets may be mounted in selected loops 66. Necklaces may be mounted inside the large pocket or in the folds. Earrings may be mounted on selected loops such as 58 and 60 as shown.

The primary support panel is preferably provided with fasteners, e.g. hook and loop 86 at the bottom of the front panel to mate with a corresponding fastener 88 on the back face (FIG. 3) to secure it closed (FIG. 4). The top flap of the primary support panel is provided with fastener 90 (FIG. 3) to mate with fastener 92 to hold it down when closed. The top and bottom ends of the support panel is preferably provided with stiffening battens 94 and 96 (FIG. 2) to aid in support of the panel. A finger pull tab 98 provides means to grasp to open the case.

Figure 7:
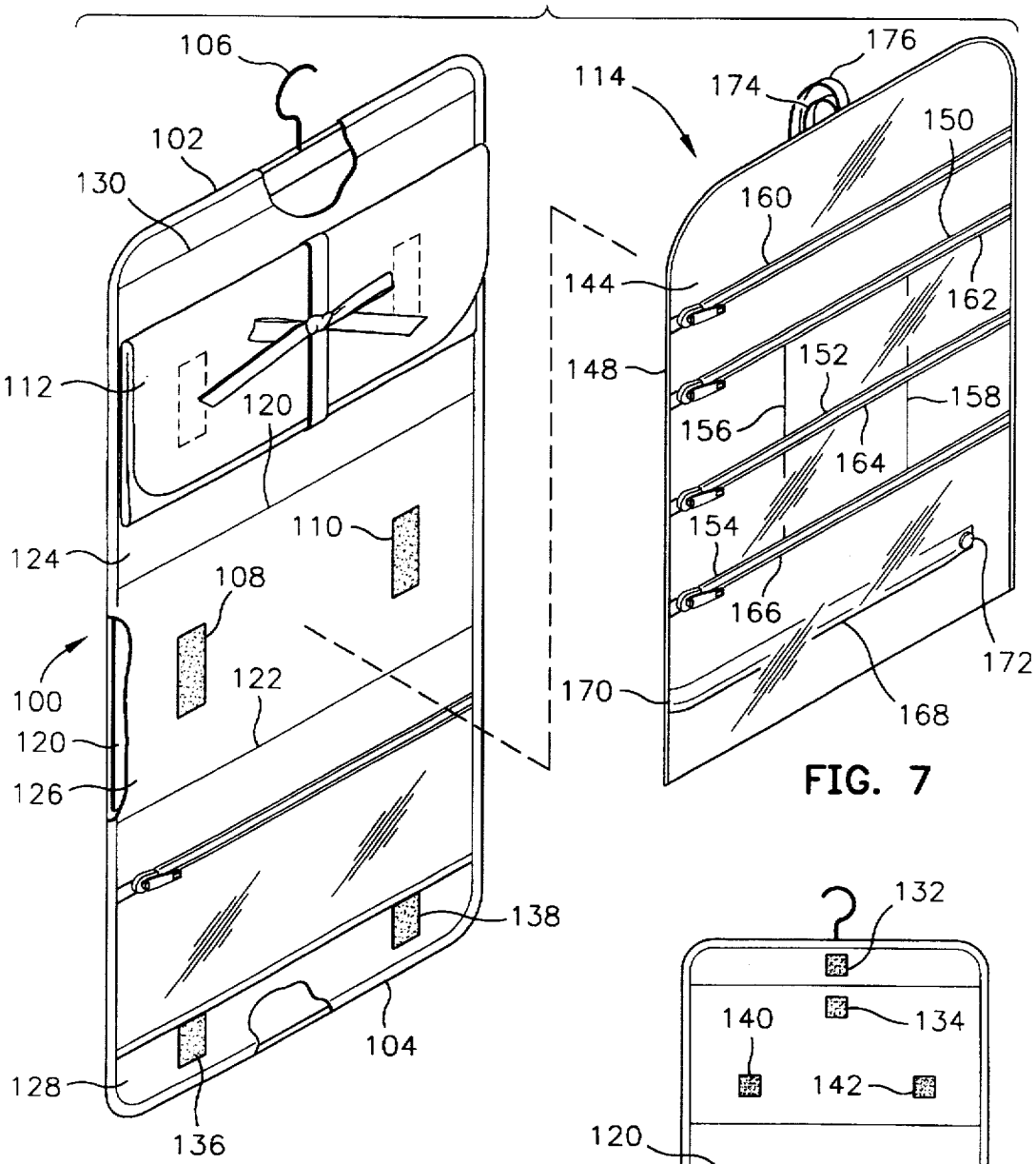
FIG. 7 is a perspective view like FIG. 2 with a pocket shown removed and portions broken away to show details.

Referring to FIG. 7, an alternate embodiment of the invention is illustrated and designated generally by the numeral 100. The primary support panel as shown in the illustrated embodiment is similar to that of the prior embodiment and comprises an elongated generally rectangular cover panel having an upper end or edge 102 and a lower end or edge 104 with a hanger hook or structure 106 at the upper end for hanging it on a suitable wall hook or closet clothes rod or any other suitable hanging means. The panel is provided on its inner surface, as illustrated in FIG. 7, with multiple sets of attachment means (only one set shown) 106 and 110 for detachably attaching a plurality of pocket assemblies. The illustrated embodiment is constructed for the attachment of two pocket assemblies or units 112 and 114.

Figure 8:
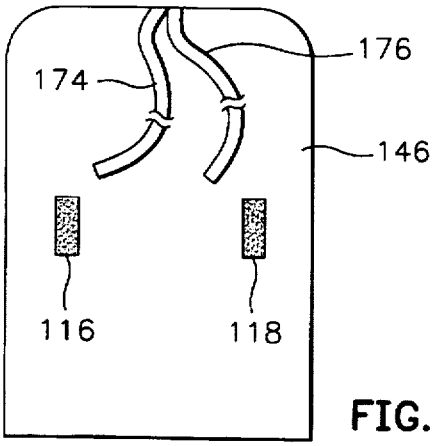
FIG. 8 is a back elevation view of a pocket of FIG. 7.

Each pocket assembly is provided with attachment means in the form of hook and loop fastening means, commonly available under the trademark "velcro" for detachably attaching the pocket assemblies to the inside or inner face of the panel at the respective attachment set. For example, as illustrated in FIG. 8, pocket assembly 104 is shown removed and fastener pads 116 and 118 are adapted to engage fastener pads 108 and 110 on the inner face of the primary panel 110. The primary panel is also preferably provided with a stiffener panel, such as cardboard (only one shown) 120 at each pocket assembly attachment position.

The primary support panel, as in the prior embodiment, folds across transverse lines 120 and 122 dividing the primary panel into three panels or sections 124, 126 and 128. The primary panel has sufficient length to define a flap at the upper end and a lower end section so that when rolled or folded over the center section and pocket assemblies, the lower flap can be secured so that the case is in the closed condition with the support panel wrapped around the multiple pocket assemblies as in the FIG. 1 embodiment. The hanger section folds along a transverse line 130 and has fastening means 132 engaging fastening means 134 to hold it in place.

Figure 9:
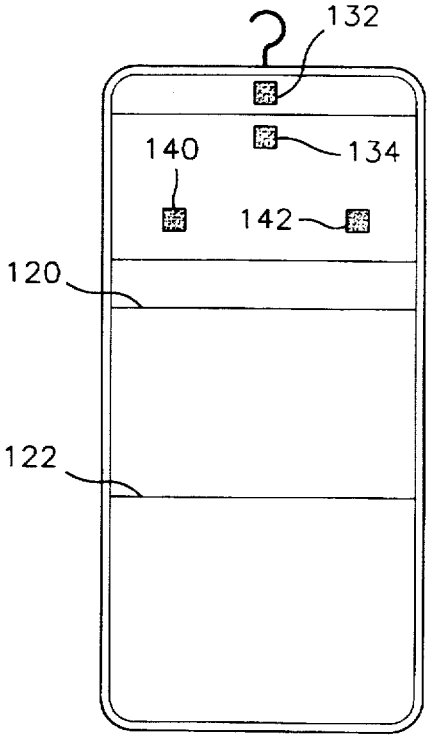
FIG. 9 is a back elevation view of the embodiment FIG. 7.

The lower panel 128 has fastening means 136 and 138 which engage fastening means 140 and 142 on the back of the upper panel of the primary panel as seen in FIG. 9. This enables the folding and closure of the entire jewelry carrying case assembly.

Referring to FIG. 7, a pocket assembly 114 comprises a front panel 144 and a back panel 146 secured along a peripheral edge 148 such as by sewing or the like. The face panel is also secured to the back panel along horizontal or transverse lines 150, 152 and 154 forming a bottom of a plurality of pockets. The panels are also secured along vertical or longitudinal lines 156 and 158 forming side edges of a plurality of small pockets.

A closure 160 such as a zipper closes an opening into an upper pocket formed between the front and back panels with a lower edge or bottom at 150. A zipper closes an opening into three pockets formed between the front and back panels and side edges at lines 156 and 158 and bottom 152. A second set of three pockets are formed between zipper 164, lines 156 an 158 and bottom 154. A bottom pocket is formed between the front and back panels and zipper 166. A ring mounting cylinder 168 is mounted in the lower pocket and secured at one end 170 to the front and back panels and detachably secured at the other end by suitable means such as a snap to the back panel.

In operation many items of jewelry not shown are selected and selectively mounted in the various pockets or on the mounting cylinder in a suitable manner. Selected items that are to be worn together may be grouped and positioned at selective positions in the various pockets around the pocket assemblies. Rings may be mounted either in groups in selected pockets, or on the mounting cylinder 168. Similarly, bracelets may be mounted in selected pockets of appropriate size. Necklaces may be mounted inside the large pocket or in the folds. Earrings may also be mounted in selected pockets such as the small pockets.

The jewelry case may have any number of the pocket assemblies from 1 or 2 to 6 if desired. It is designed to easily place in a suitcase for ease of carrying and to be hung from a hanging rod in a closet in a hotel room or the like, to provide easy access.

While I have illustrated and described my invention by means of specific embodiments, it is to be understood that numerous changes and modifications may be made therein without departing from the spirit and the scope of the invention as shown in the appended claims.

I claim:

1. A jewelry carrying case, comprising:

a primary shell of pliable material, said shell formed of a rectangular panel having an inner face and an outer face and foldable along selected lines transverse of the back panel forming a primary receptacle;

a pocket assembly for detachably securing to said inner face of said panel inside said primary receptacle, said pocket comprising a back pocket panel and a front pocket panel secured together along at least a bottom and side edges forming a pocket; and jewelry mounting means in said pocket for detachably mounting a plurality of selected items of jewelry.

2. The carrying case of claim 1 wherein at least said front of said pocket panel is transparent.

3. The carrying case of claim 1 wherein said pocket assembly includes a closure panel and said closure panel is at least partially transparent.

4. The carrying case of claim 1 wherein said pocket assembly is detachably secured to said back panel by means of hook and loop fastening means.

5. The carrying case of claim 1 wherein said mounting means is a mounting panel comprising a stiffening panel and a pliable fabric covering.

6. The carrying case of claim 5 wherein said mounting panel comprises a front face and said mounting means is on said front face.

7. The carrying case of claim 6 wherein said mounting panel comprises a cover panel for covering said a front face and said attachment means.

8. The carrying case of claim 7 wherein said attachment means comprises a plurality of straps and at least one overlapping fold.

9. The carrying case of claim 1 wherein said attachment means comprises a plurality of straps, a mounting cylinder and at least one overlapping fold.

10. The carrying case of claim 9 comprising a plurality of said pocket assemblies detachably mounted in said receptacle by means of hook and loop fastening means.

11. The carrying case of claim 10 comprising a plurality of said pocket assemblies detachably mounted in said receptacle by means of hook and loop fastening means.

12. The carrying case of claim 11 wherein said mounting panel comprises a stiffening panel and a pliable fabric covering including a front face, and said mounting means is on said front face.

13. The carrying case of claim 12 wherein said mounting panel comprises a cover panel for covering said a front face and said attachment means.

14. The carrying case of claim 12 wherein said primary shell includes hanging means for hanging said carrying case on suitable support structure, said hanging means inside said when in a closed configuration.

15. A carrying case for jewelry, said case comprising:

a primary panel of pliable material having a generally rectangular configuration and an inner face and an outer face, said panel having a top end and a bottom end, hanging means at said top end, said panel foldably along a transverse line for forming a primary receptacle having a front panel and a back panel;

a pocket assembly for detachably securing to said back panel inner face, said pocket assembly comprising a back pocket panel and a front pocket panel secured together along a bottom and side edges forming a pocket; and a mounting panel removeably mounted in said pocket and having a mounting face, a plurality of attachment loops on said mounting face for mounting articles of jewelry, an elongate generally cylindrical support member detachably mounted on said panel, and a cover panel secured along an edge to one of an upper and a lower edge of said mounting panel to thereby overlap and cover said mounting face.

16. The carrying case of claim 15 wherein at least said front pocket panel is transparent.

17. The carrying case of claim 16 wherein said pocket assembly is detachably secured to said back panel by means of hook and loop fastening means.

18. The carrying case of claim 15 wherein said mounting panel comprises a stiffening panel having a pliable fabric covering, and a cover panel for covering said a front face and said attachment means.

19. The carrying case of claim 18 comprising a plurality of said pocket assemblies detachably mounted in said receptacle by means of hook and loop fastening means.

20. A carrying case for jewelry, said case comprising:

a primary panel of pliable material having a generally elongated rectangular configuration and an inner face and an outer face, said panel having a top end and a bottom end, hanging means at said top end, said panel foldable along transverse lines for forming a primary receptacle having a front panel and a back panel;

a plurality of pocket assemblies detachably secured to said back panel inner face by means of hook and loop fastening means, each said pocket assembly comprising a back pocket panel and a front pocket panel secured together along a bottom and side edges forming a pocket; and a mounting panel comprising a stiffening panel having a pliable fabric covering said stiffening panel and defining a mounting face, said mounting panel removeably mounted in said pocket and said mounting face having a plurality of attachment loops on said mounting face for mounting articles of jewelry, an elongate generally cylindrical support member detachably mounted on said panel, and a cover panel secured along an edge to one of an upper and a lower edge of said mounting panel to thereby overlap and cover said mounting face.

* * * * *